US009145852B2

(12) United States Patent
Winsor et al.

(10) Patent No.: US 9,145,852 B2
(45) Date of Patent: Sep. 29, 2015

(54) POWER SYSTEM COMPRISING AN EGR SYSTEM

(71) Applicant: DEERE & COMPANY, Moline, IL (US)

(72) Inventors: Richard E Winsor, Waterloo, IA (US); Brian H Bratvold, New Hartford, IA (US); Yirot Pino, Cedar Falls, IA (US)

(73) Assignee: DEERE & COMPANY, Moline, IL (US)

( * ) Notice: Subject to any disclaimer, the term of this patent is extended or adjusted under 35 U.S.C. 154(b) by 23 days.

(21) Appl. No.: 14/147,103

(22) Filed: Jan. 3, 2014

(65) Prior Publication Data

US 2015/0192094 A1 Jul. 9, 2015

(51) Int. Cl.

| | |
|---|---|
| ***F02B 33/44*** | (2006.01) |
| ***F02B 47/08*** | (2006.01) |
| ***F01N 5/04*** | (2006.01) |
| ***F02M 25/06*** | (2006.01) |
| ***F01N 3/00*** | (2006.01) |
| ***F02M 25/07*** | (2006.01) |

(52) U.S. Cl.

CPC ..... *F02M 25/0715* (2013.01)

(58) Field of Classification Search

CPC ..... F02M 25/0706; F02M 28/0707; F02M 25/0709; F02M 25/071; F01N 3/30; F01N 3/303; F01N 3/306; F01N 3/32; F01N 3/34

USPC ..... 701/108; 60/605.2, 280, 285, 286, 289, 60/291, 293

See application file for complete search history.

(56) References Cited

U.S. PATENT DOCUMENTS

| | | | | |
|---|---|---|---|---|
| 4,215,550 | A * | 8/1980 | Dinger et al. | 60/606 |
| 4,328,672 | A * | 5/1982 | Zumstein | 60/606 |
| 4,426,848 | A * | 1/1984 | Stachowicz | 60/605.2 |
| 5,406,796 | A * | 4/1995 | Hiereth et al. | 60/605.2 |
| 5,724,813 | A * | 3/1998 | Fenelon et al. | 60/606 |
| 6,276,139 | B1 * | 8/2001 | Moraal et al. | 60/605.2 |
| 6,381,961 | B1 * | 5/2002 | Bischoff | 60/605.2 |
| 6,435,166 | B1 * | 8/2002 | Sato et al. | 123/568.12 |
| 6,715,287 | B1 * | 4/2004 | Engel et al. | 60/601 |
| 7,047,742 | B2 * | 5/2006 | Kono et al. | 60/605.2 |
| 7,322,194 | B2 * | 1/2008 | Sun et al. | 60/605.2 |
| 7,779,634 | B2 * | 8/2010 | Barthelet et al. | 60/607 |
| 2002/0083700 | A1 * | 7/2002 | Ellmer et al. | 60/278 |
| 2008/0134677 | A1 * | 6/2008 | Onodera | 60/601 |
| 2008/0216476 | A1 * | 9/2008 | Evers | 60/605.2 |
| 2009/0223218 | A1 * | 9/2009 | Winsor et al. | 60/600 |
| 2010/0175671 | A1 * | 7/2010 | Gerum | 123/568.29 |

(Continued)

FOREIGN PATENT DOCUMENTS

| | | | | |
|---|---|---|---|---|
| DE | 3225867 | A1 * | 1/1984 | F02B 37/12 |
| EP | 1770270 | A2 * | 4/2007 | F02M 25/07 |
| WO | WO 2004104390 | A1 * | 12/2004 | F02B 37/10 |

*Primary Examiner* — Thomas Denion
*Assistant Examiner* — Jessica Kebea

(57) ABSTRACT

A power system including an engine, an intake system, an exhaust system, and an EGR system. The intake system is coupled to the engine and receives a fresh intake gas, the fresh intake gas having a fresh intake gas pressure. The exhaust system is coupled to the engine and expels an exhaust gas, the exhaust gas having an exhaust gas pressure. The EGR system is positioned so as to couple the intake system and the exhaust system. The EGR system does not comprise an EGR cooler. The EGR system bypasses periodically a portion of the fresh intake gas around the engine, from the intake system to the exhaust system, when the fresh intake gas pressure is greater than the exhaust gas pressure.

11 Claims, 2 Drawing Sheets

(56) References Cited

U.S. PATENT DOCUMENTS

2011/0072803 A1* 3/2011 Van Nieuwstadt et al. ..... 60/287
2013/0305715 A1* 11/2013 Rollinger et al. ..... 60/605.2
2013/0305716 A1* 11/2013 Rollinger et al. ..... 60/605.2
2013/0311068 A1* 11/2013 Rollinger et al. ..... 701/104
2014/0013741 A1* 1/2014 Ukropec et al. ..... 60/605.2

* cited by examiner

POWER SYSTEM COMPRISING AN EGR SYSTEM

FIELD OF THE DISCLOSURE

The present disclosure relates to a power system comprising an exhaust gas recirculation ("EGR") system. More specifically, the present disclosure relates to an EGR system being configured to bypass periodically a portion of the fresh intake gas around the engine.

BACKGROUND OF THE DISCLOSURE

Manufacturers of nonroad diesel power systems are expected to meet set emissions regulations. For example, Tier 3 emissions regulations required an approximate 65 percent reduction in particulate matter ("PM") and a 60 percent reduction in nitrogen oxides ("$NO_x$") from 1996 levels. As a further example, Interim Tier 4 regulations required a 90 percent reduction in PM along with a 50 percent drop in $NO_x$. Still further, Final Tier 4 regulations, which will be fully implemented by 2015, will take PM and $NO_x$ emissions to near-zero levels. Manufacturers of maritime power systems are also expected to meet emissions regulations, though they vary from the nonroad emissions regulations (e.g., International Maritime Organization regulations).

One technique for reducing $NO_x$ involves introducing chemically inert gas into the fresh intake gas for subsequent combustion. By reducing the oxygen concentration of the resulting charge to be combusted, the fuel burns slower and peak combustion temperatures lower, which lowers $NO_x$ production. In an internal combustion engine environment, such chemically inert gases are readily abundant in the form of exhaust gas, and one known method for achieving the foregoing result is through the use of an EGR system operable to controllably introduce a recirculated portion of the exhaust gas, from the exhaust manifold, into an intake manifold. Having an EGR system results in cooler combustion temperatures, reduced $NO_x$ formation, optimized fuel economy, and improved overall performance.

Modern power systems often times have one or more turbochargers, which are an effective means for supplying increased fresh intake gas volume and pressure. However, at low engine speeds and simultaneous high engine loads, some turbochargers may be prone to providing insufficient boost, resulting in the formation of engine smoke.

SUMMARY OF THE DISCLOSURE

Disclosed is a power system having an engine, an intake system, an exhaust system, and an EGR system. The intake system is coupled to the engine and receives a fresh intake gas, the fresh intake gas having a fresh intake gas pressure. Further, the exhaust system is coupled to the engine and expels an exhaust gas, the exhaust gas having an exhaust gas pressure. The EGR system is positioned so as to couple the intake system and the exhaust system. The EGR system does not comprise an EGR cooler. In operation, the EGR system bypasses periodically a portion of the fresh intake gas around the engine, from the intake system to the exhaust system, when the fresh intake gas pressure is greater than the exhaust gas pressure. In certain operating modes, by bypassing the portion of the fresh intake gas around the engine, the turbocharger boost pressure increases, so that the air-to-fuel ratio also increases and the smoke formation decreases.

BRIEF DESCRIPTION OF THE DRAWINGS

The detailed description of the drawings refers to the accompanying figures in which.

DETAILED DESCRIPTION OF THE DRAWINGS

Figure 1:
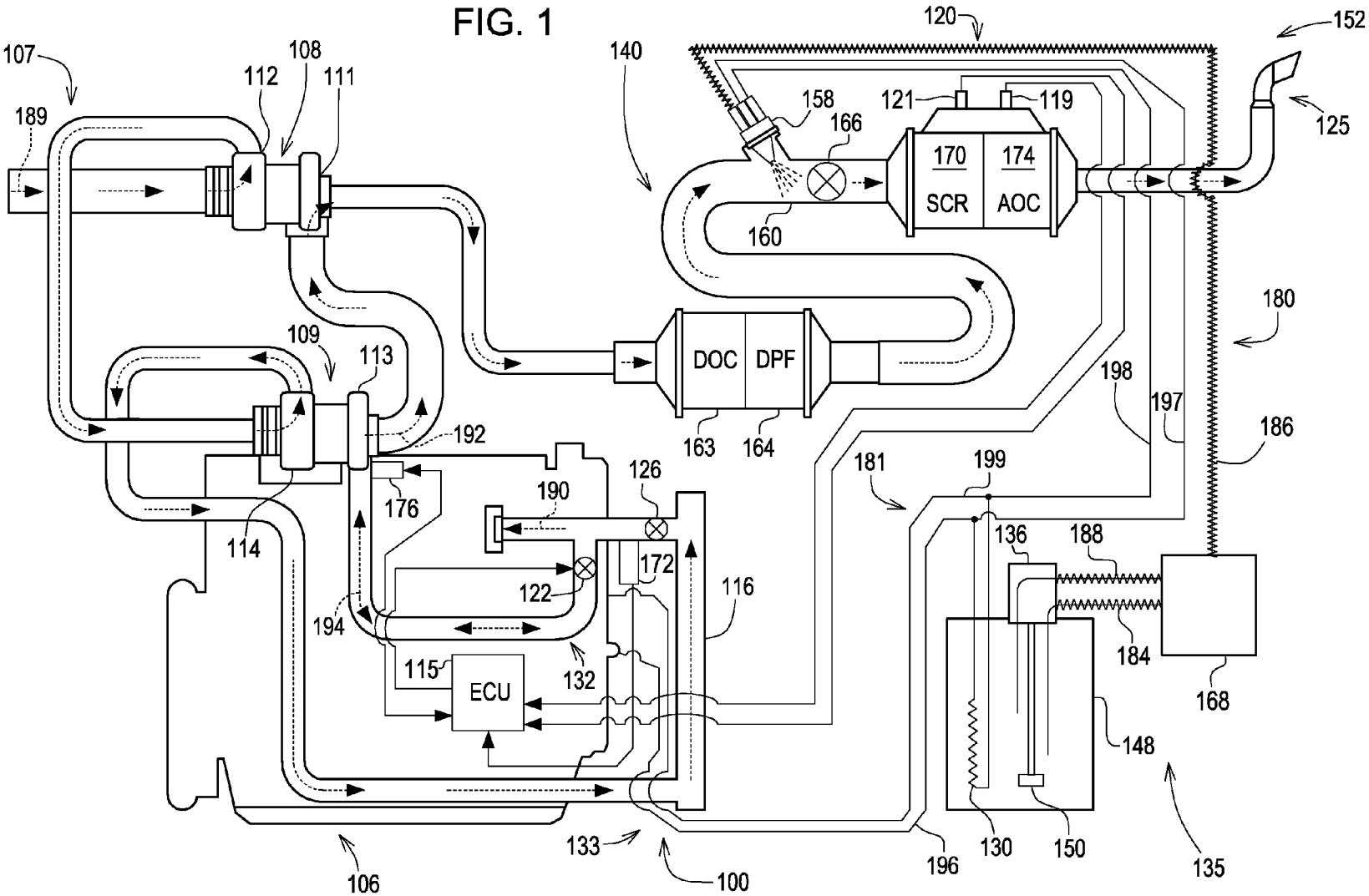
FIG. 1 is a schematic illustration of a power system having an EGR system.

Referring to FIG. 1, there is shown a schematic illustration of a power system 100 for providing power to a variety of machines, including on-highway trucks, construction vehicles, marine vessels, stationary generators, automobiles, agricultural vehicles, and recreation vehicles. The engine 106 may be any kind that produces an exhaust gas, as indicated by directional arrow 192. For example, engine 106 may be an internal combustion engine, such as a gasoline engine, a diesel engine, a gaseous fuel burning engine (e.g., natural gas), or any other exhaust gas producing engine. The engine 106 may be of any size, with any number cylinders (not shown), and in any configuration (e.g., "V," inline, and radial). The engine 106 may include various sensors, such as temperature sensors, pressure sensors, and mass flow sensors—some of which are shown in FIG. 1.

The power system 100 may comprise an intake system 107 that includes components for introducing a fresh intake gas, as indicated by directional arrow 189, into the engine 106. Among other things, the intake system 107 may include an intake manifold (not shown) in communication with the cylinders, a compressor 112, a charge air cooler 116, and an air throttle actuator 126. The compressor 112 may be a fixed geometry compressor, a variable geometry compressor, or any other type of compressor that is capable of receiving the fresh intake gas from upstream of the compressor 112. The compressor 112 compresses the fresh intake gas to an elevated pressure level. As shown, a charge air cooler 116 may be positioned downstream of the compressor 112 for cooling the fresh intake gas.

The air throttle actuator 126 may be positioned downstream of the charge air cooler 116, and it may be, for example, a flap type valve controlled by an electronic control unit (ECU) 115 to regulate the air-fuel ratio. The air throttle actuator 126 is open during normal operation and when the engine 106 is off. However, in order to raise the exhaust temperature prior to, and during, active exhaust filter regeneration, the ECU 115 progressively closes the air throttle actuator 126. This creates a restriction, reducing the air flow and thereby causing the exhaust temperature to increase. The ECU 115 receives position feedback from an internal sensor within the air throttle actuator 126.

Further, the power system 100 includes an exhaust system 140, having components for directing exhaust gas from the engine 106 to the atmosphere. The exhaust system 140 may include an exhaust manifold (not shown) in fluid communication with the cylinders. During an exhaust stroke, at least one exhaust valve (not shown) opens, allowing the exhaust gas to flow through the exhaust manifold and a turbine 111. The pressure and volume of the exhaust gas drives the turbine 111, allowing it to drive the compressor 112 via a shaft (not shown). The combination of the compressor 112, the shaft, and the turbine 111 is known as a turbocharger 108.

The power system 100 may also have, for example, a second turbocharger 109 that cooperates with the turbocharger 108 (i.e., series turbocharging). The second turbocharger 109 includes a second compressor 114, a second shaft (not shown), and a second turbine 113. The second compressor 114 may be a fixed geometry compressor, a variable geometry compressor, or any other type of compressor capable of receiving fresh intake gas, from upstream of the second compressor 114, and compressing the fresh intake gas to an elevated pressure level before it enters the engine 106.

The power system 100 includes an EGR system 132 for receiving a recirculated portion of the exhaust gas, as indicated by directional arrow 194, in some operating modes. Having an EGR system 132 results in cooler combustion temperatures, thereby reducing $NO_x$, optimizing fuel economy, and improving overall performance. The intake gas is indicated by directional arrow 190, and it is a combination of the fresh intake gas and the recirculated portion of the exhaust gas. The EGR valve 122 may be a vacuum controlled valve, allowing a specific amount of the recirculated portion of the exhaust gas back into the intake manifold, for example.

The illustrated embodiment of an EGR system 132 is shown having neither an EGR cooler nor an EGR mixer. Having either may impede the periodic flow of a portion of the fresh intake gas around the engine 106, from the intake system 107 to the exhaust system 140, when the fresh intake gas pressure is greater than the exhaust gas pressure. These potential impediments may decrease the bypass flow, thereby decreasing the potential benefits thereof in given operating modes (e.g., raising the boost pressure of the turbocharger 108 and the second turbocharger 109).

The recirculated exhaust gas travels in pulses correlating to the exhaust strokes of the cylinders (not shown) of the engine 106. So, if the engine 106 has, for example, four cylinders, then the recirculated exhaust gas travels in one pulse per every 180° of crank rotation. The cylinders draw charges in pulses, and as a result of this, the recirculated exhaust gas and fresh intake gas turbulently mix.

In operation, the EGR system 132 bypasses periodically a portion of the fresh intake gas around the engine 106, from the intake system 107 to the exhaust system 140, when the fresh intake gas pressure is greater than the exhaust gas pressure. In some operating modes, the EGR valve 122 at least partially opens or completely opens when the fresh intake gas pressure is greater than the exhaust gas pressure, and when the engine 106 is simultaneously operating at a speed (e.g., revolutions per minute, RPM) lower than a peak torque speed. As is known in the art, the peak torque speed is the speed associated with the overall peak torque level for a given engine. For example, a torque curve for an engine tends to rise and fall versus the engine speed. The inflection point between the rise and the fall is the overall peak torque level.

Further, in some operating modes, the EGR valve 122 is at least partially open when the fresh intake gas pressure is greater than the exhaust gas pressure, when the engine 106 is simultaneously operating at a speed lower than a peak torque speed, and when the engine 106 is simultaneously loaded to a torque level of at least 65% of a maximum torque level for a respective speed. Engines are capable of providing a range of torques for any given speed. Torque curves represent the maximum torque that an engine can provide at the various engine speeds. In at least certain operating modes, by bypassing the portion of the fresh intake gas around the engine 106, the boost pressure provided by the turbocharger 108 and the second turbocharger 109 increases, resulting in the air-to-fuel ratio increasing and the smoke formation decreasing.

As further shown, the illustrated embodiment of the exhaust system 140 includes an aftertreatment system 120, and at least some of the exhaust gas passes therethrough. Other embodiments of the exhaust system 140 may not have an aftertreatment system 120 or have a different kind of aftertreatment system. The aftertreatment system 120 removes various chemical compounds and particulate emissions present in the exhaust gas received from the engine 106. After being treated by the aftertreatment system 120, the exhaust gas is expelled into the atmosphere via a tailpipe 125.

The aftertreatment system 120 may include a $NO_x$ sensor 119, the $NO_x$ sensor 119 produces and transmits a $NO_x$ signal to the ECU 115, which is indicative of a $NO_x$ content of exhaust gas flowing thereby. Exemplarily, the $NO_x$ sensor 119 may rely upon an electrochemical or catalytic reaction that generates a current, the magnitude of which is indicative of the $NO_x$ concentration of the exhaust gas.

The ECU 115 may have four primary functions: (1) converting analog sensor inputs to digital outputs, (2) performing mathematical computations for all fuel and other systems, (3) performing self diagnostics, and (4) storing information. The ECU 115 may, in response to the $NO_x$ signal, control a combustion temperature of the engine 106 and/or the amount of a reductant injected into the exhaust gas.

The aftertreatment system 120 is shown having a diesel oxidation catalyst (DOC) 163, a diesel particulate filter (DPF) 164, and a selective catalytic reduction (SCR) system 152, though the need for such components depends on the particular size and application of the power system 100. The SCR system 152 has a reductant delivery system 135, an SCR catalyst 170, and an ammonia oxidation catalyst AOC 174. The exhaust gas may flow through the DOC 163, the DPF 164, the SCR catalyst 170, and the AOC 174, and is then, as just mentioned, expel into the atmosphere via the tailpipe 125. Exhaust gas that is treated in the aftertreatment system 120 and released into the atmosphere contains significantly fewer pollutants (e.g., PM, $NO_x$, and hydrocarbons) than an untreated exhaust gas.

The DOC 163 may be configured in a variety of ways and contain catalyst materials useful in collecting, absorbing, adsorbing, and/or converting hydrocarbons, carbon monoxide, and/or oxides of nitrogen contained in the exhaust gas. Such catalyst materials may include, for example, aluminum, platinum, palladium, rhodium, barium, cerium, and/or alkali metals, alkaline-earth metals, rare-earth metals, or combinations thereof. The DOC 163 may include, for example, a ceramic substrate, a metallic mesh, foam, or any other porous material known in the art, and the catalyst materials may be located on, for example, a substrate of the DOC 163. The DOC(s) may also oxidize NO contained in the exhaust gas, thereby converting it to $NO_2$ upstream of the SCR catalyst 170.

The DPF 164 may be any of various particulate filters known in the art that are capable of reducing PM concentrations (e.g., soot and ash) in the exhaust gas, so as to meet requisite emission standards. Any structure capable of removing PM from the exhaust gas of the engine 106 may be used. For example, the DPF 164 may include a wall-flow ceramic substrate having a honeycomb cross-section constructed of cordierite, silicon carbide, or other suitable material to remove the PM. The DPF 164 may be electrically coupled to a controller, such as the ECU 115, that controls various characteristics of the DPF 164.

If the DPF 164 were used alone, it would initially help in meeting the emission requirements, but would quickly fill up with soot and need to be replaced. Therefore, the DPF 164 may be combined with the DOC 163, so as to extend the life of the DPF 164 through the process of regeneration. The ECU 115 may measure the PM build up, also known as filter loading, in the DPF 164, using a combination of algorithms and sensors. When filter loading occurs, the ECU 115 manages the initiation and duration of the regeneration process.

Moreover, the reductant delivery system 135 may include a reductant tank 148 for storing the reductant. One example of a reductant is a solution having 32.5% high purity urea and 67.5% deionized water (e.g., DEF), which decomposes as it travels through a decomposition tube 160 to produce ammonia. Such a reductant may begin to freeze at approximately 12 deg F. (−11 deg C.). If the reductant freezes when a machine is shut down, then the reductant may need to be thawed before the SCR system 152 can function.

The reductant delivery system 135 may include a reductant header 136 mounted to the reductant tank 148, the reductant header 136 further including, in some embodiments, a level sensor 150 for measuring a quantity of the reductant in the reductant tank 148. The level sensor 150 may include a float for floating at a liquid/air surface interface of reductant included within the reductant tank 148. Other implementations of the level sensor 150 are possible, and may include, for example, one or more of the following: (1) using one or more ultrasonic sensors, (2) using one or more optical liquid-surface measurement sensors, (3) using one or more pressure sensors disposed within the reductant tank 148, and (4) using one or more capacitance sensors.

In the illustrated embodiment, the reductant header 136 includes a tank heating element 130 that receives coolant from the engine 106. The power system 100 may include a cooling system 133 having a coolant supply passage 180 and a coolant return passage 181. The cooling system 133 may be an opened system or a closed system, depending on the specific application, while the coolant may be any form of engine coolant, including fresh water, sea water, an antifreeze mixture, and the like.

A first segment 196 of the coolant supply passage 180 may be positioned fluidly, between the engine 106 and the tank heating element 130, for supplying coolant to the tank heating element 130, as is shown. The coolant may circulate, through the tank heating element 130, so as to warm the reductant in the reductant tank 148, thereby reducing the risk that the reductant freezes therein and/or thawing the reductant upon startup. In an alternative embodiment, the tank heating element 130 may, instead, be an electrically resistive heating element. A second segment 197 of the coolant supply passage 180 may be positioned fluidly between the tank heating element 130 and a reductant delivery mechanism 158 for supplying coolant thereto. The coolant heats the reductant delivery mechanism 158, reducing the risk that reductant freezes therein.

A first segment 198 of the coolant return passage 181 may be positioned between the reductant delivery mechanism 158 and the tank heating element 130, and a second segment 199 of the coolant return passage 181 may be positioned between the engine 106 and the tank heating element 130. The first segment 198 and the second segment 199 return the coolant to the engine 106.

The decomposition tube 160 may be positioned downstream of the reductant delivery mechanism 158 but upstream of the SCR catalyst 170. The reductant delivery mechanism 158 may be, for example, an injector that is selectively controllable to inject reductant directly into the exhaust gas. As shown, the SCR system 152 may include a reductant mixer 166 that is positioned upstream of the SCR catalyst 170 and downstream of the reductant delivery mechanism 158.

The reductant delivery system 135 may additionally include a reductant pressure source (not shown) and a reductant extraction passage 184. The extraction passage 184 may be coupled fluidly to the reductant tank 148 and the reductant pressure source therebetween. Although the extraction passage 184 is shown extending into the reductant tank 148, in other embodiments, the extraction passage 184 may be coupled to an extraction tube via the reductant header 136. The reductant delivery system 135 may further include a reductant supply module 168, such as a Bosch reductant supply module (e.g., the Bosch Denoxtronic 2.2-Urea Dosing System for SCR Systems).

The reductant delivery system 135 may also include a reductant dosing passage 186 and a reductant return passage 188. The return passage 188 is shown extending into the reductant tank 148, though in some embodiments of the power system 100, the return passage 188 may be coupled to a return tube via the reductant header 136. And the reductant delivery system 135 may have—among other things—valves, orifices, sensors, and pumps positioned in the extraction passage 184, reductant dosing passage 186, and return passage 188.

As mentioned above, one example of a reductant is a solution having 32.5% high purity urea and 67.5% deionized water (e.g., DEF), which decomposes as it travels through the decomposition tube 160 to produce ammonia. The ammonia reacts with $NO_x$ in the presence of the SCR catalyst 170, and it reduces the $NO_x$ to less harmful emissions, such as $N_2$ and $H_2O$. The SCR catalyst 170 may be any of various catalysts known in the art. For example, in some embodiments, the SCR catalyst 170 may be a vanadium-based catalyst. But in other embodiments, the SCR catalyst 170 may be a zeolite-based catalyst, such as a Cu-zeolite or a Fe-zeolite. The AOC 174 may be any of various flowthrough catalysts for reacting with ammonia and thereby produce nitrogen. Generally, the AOC 174 is utilized to remove ammonia that has slipped through or exited the SCR catalyst 170. As shown, the AOC 174 and the SCR catalyst 170 may be positioned within the same housing 154 (as shown in FIGS. 1-7), but in other embodiments, they may be separate from one another. As shown, the housing 154 may form a longitudinal housing axis 173.

Figure 2:
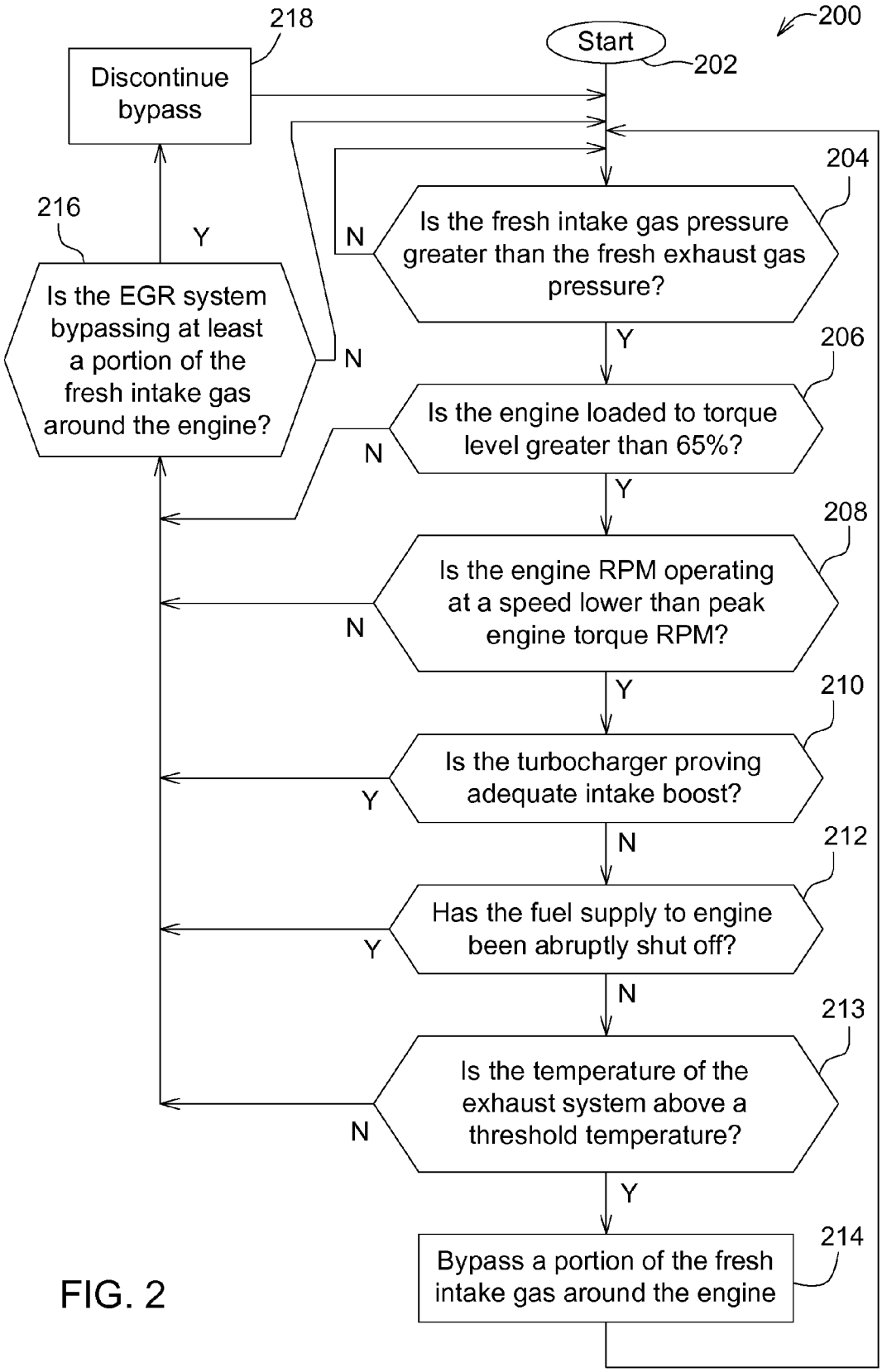
FIG. 2 is a flow chart of a method for operating the power system.

Referring to FIG. 2, there is shown a method 200 comprising bypassing a portion of the fresh intake gas around the engine 106, from the intake system 107 to the exhaust system 140, when the fresh intake gas pressure is greater than the exhaust gas pressure. The method 200 starts at act 202, and at act 204 determines whether the fresh intake gas pressure is greater than the exhaust gas pressure. The fresh intake gas pressure may be measured by a pressure sensor 176, for example, and the exhaust gas pressure may be measured by a pressure sensor 172, for example. If the fresh intake gas pressure is lower than the exhaust gas pressure, then the act 204 starts over.

If the fresh intake gas pressure is higher than the exhaust gas pressure, then act 206 of the method 200 determines whether the engine 106 is loaded to a torque level of at least 65% of a maximum torque level for a respective speed. If the engine 106 is loaded to a torque level below 65% of the maximum torque level for a respective speed, then the method 200 proceeds to act 216. Act 216 determines whether the EGR system 132 is bypassing at least a portion of the fresh intake gas around the engine 106. If so, act 218 discontinues the bypass, and if not, act 204 starts over. If the engine 106 is loaded to a torque level above 65% of the maximum torque level for a respective speed, then the method 200 proceeds to act 208.

Act 208 determines an operating speed of the engine 106 and a peak torque speed of the engine 106 (e.g., the RPM). If the operating speed of the engine 106 is greater than the peak torque speed, then the method 200 proceeds to act 216, but if the operating speed of the engine 106 is less than the peak torque speed, then the method 200 proceeds to act 210.

Act 210 determines whether the turbocharger 108 is providing an adequate boost level, the adequate boost level being a boost necessary to power the engine 106 at a respective time.

If the turbocharger 108 is providing an adequate boost level, then the method 200 proceeds to act 216, and alternatively, if the turbocharger 108 is not providing an adequate boost level, then the method 200 proceeds to act 212.

Act 212 determines whether a fuel source being provided to the engine 106 has been abruptly cut off from the engine 106. If the fuel source has been abruptly cut off from the engine 106, then the method 200 proceeds to act 216. In such a case, the turbocharger 108 and the second turbocharger 109 may be providing adequate boost, so bypassing the fresh intake gas may be unnecessary. In contrast, if the fuel source has not been abruptly cut off from the engine 106, then the method 200 proceeds to act 213.

Act 213 determines whether a temperature of the exhaust system 140 is above a threshold temperature, the threshold temperature being a temperature necessary to maintain proper operation of the DOC 163 and the DPF 164 for a given operating mode of the engine 106. The method 200 may be used in the power system 200, as shown with the aftertreatment system 120, but it may also be used in a system that does not have an aftertreatment system. If the temperature of the exhaust system 140 is below a threshold temperature, then the method 200 proceeds to act 216. The temperature may be measured via temperature sensor 154. Conversely, if the temperature of the exhaust system 140 is above a threshold temperature, then the method 200 proceeds to act 214.

Act 214 bypasses a portion of the fresh intake gas around the engine 106. The bypassing may comprise opening an EGR valve 122 at least partially or completely, depending on the particular operating mode and demands of the engine 106. By bypassing the portion of the fresh intake gas around the engine 106, the boost pressure of turbocharger 108 and the second turbocharger 109 increases, so that the air-to-fuel ratio also increases and the smoke formation decreases.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A power system, comprising:

an engine;

an intake system being coupled to the engine and configured to receive a fresh intake gas, the fresh intake gas having a fresh intake gas pressure;

an exhaust system being coupled to the engine and configured to expel an exhaust gas, the exhaust gas having an exhaust gas pressure; and an exhaust gas recirculation ("EGR") system, the EGR system being positioned so as to couple the intake system and the exhaust system, the EGR system comprising an EGR valve positioned between the intake system and the exhaust system, the EGR system not comprising an EGR cooler, the EGR system being configured to bypass periodically a portion of the fresh intake gas around the engine, from the intake system to the exhaust system, when the fresh intake gas pressure is greater than the exhaust gas pressure, and the EGR valve being configured to be at least partially open when the fresh intake gas pressure is greater than the exhaust gas pressure, when the engine is simultaneously operating at a speed lower than a peak torque speed, and when the engine is simultaneously loaded to a torque level of at least 65% of a maximum torque level for a respective speed.

2. The power system of claim 1, wherein the EGR system does not comprise an EGR mixer.

3. The power system of claim 1, wherein the EGR valve is configured to be completely open when the fresh intake gas pressure is greater than the exhaust gas pressure.

4. A method for a power system, the power system comprising:

an engine;

an intake system being coupled to the engine and configured to receive a fresh intake gas, the fresh intake gas having a fresh intake gas pressure;

an exhaust system being coupled to the engine and configured to expel an exhaust gas, the exhaust gas having an exhaust gas pressure; and an exhaust gas recirculation ("EGR") system, the EGR system being positioned so as to couple the intake system and the exhaust system, the EGR system not comprising an EGR cooler, the method comprising:

bypassing a portion of the fresh intake gas around the engine via the EGR system, from the intake system to the exhaust system, when the fresh intake gas pressure is greater than the exhaust gas pressure; and determining whether the engine is operating at a speed lower than a peak torque speed, and the bypassing occurs based at least in part on the determination that the engine is operating below the peak torque speed.

5. The method for a power system of claim 4, wherein the EGR system does not comprise an EGR mixer.

6. The method for the power system of claim 4, wherein the bypassing comprises opening an EGR valve at least partially.

7. The method for the power system of claim 4, wherein the bypassing comprises opening an EGR valve completely.

8. The method for the power system of claim 4, wherein the power system comprises a turbocharger coupled to the intake system and the exhaust system, and the method comprises determining whether the turbocharger is providing an adequate boost level, the adequate boost level is a boost necessary to power the engine at a respective time, and the bypassing is based at least in part on the determination that the turbocharger is not providing the adequate boost level.

9. The method for the power system of claim 4, comprising determining whether a fuel source being provided to the engine has been abruptly cut off from the engine, and wherein the bypassing is based at least in part on the determination that the fuel source has not been abruptly cut off from the engine.

10. The method for the power system of claim 4, wherein the exhaust system comprises diesel oxidation catalyst ("DOC") downstream of the engine and a diesel particulate filter ("DPF") downstream of the DOC, and the method comprises determining whether a temperature of the exhaust system is above a threshold temperature, the threshold temperature is a temperature necessary to maintain proper operation of the DOC and DPF for a respective operating mode of the engine, and the bypassing is based at least in part on the determination that the temperature of the exhaust system is above the threshold temperature.

11. The method for the power system of claim 4, comprising determining whether the torque level is at least 65% of a maximum torque level for a respective speed, and the bypassing occurs based at least in part on the determination that the torque level is at least 65% of the maximum torque level for the respective speed.

* * * * *